United States Patent [19]

McAllister

[11] Patent Number: 4,469,991

[45] Date of Patent: Sep. 4, 1984

[54] METHOD AND APPARATUS FOR IMPROVING FLASHLAMP PERFORMANCE

[75] Inventor: Gary L. McAllister, Richland, Wash.

[73] Assignee: Jersey Nuclear-Avco Isotopes, Inc., Bellevue, Wash.

[21] Appl. No.: 257,803

[22] Filed: Apr. 27, 1981

[51] Int. Cl.[3] ..... H05B 41/30

[52] U.S. Cl. ..... 315/246; 315/174; 315/241 R; 372/25; 372/70; 328/109

[58] Field of Search ..... 315/246, 268, 269, 270, 315/271, 326, 341, 349, 350, 351, 160, 174, 241 R, 176; 372/25, 69, 70, 90, 91; 328/108, 109

[56] References Cited

U.S. PATENT DOCUMENTS

| | | | |
|---|---|---|---|
| 3,646,395 | 2/1972 | De Pratti | 315/208 X |
| 3,646,471 | 2/1972 | De Ment | 431/97 X |
| 3,668,548 | 6/1972 | Osial et al. | 372/69 X |
| 3,842,284 | 10/1974 | Berta et al. | 250/493 |
| 3,967,212 | 6/1976 | Dere et al. | 350/166 X |
| 4,004,248 | 1/1977 | Müller et al. | 372/69 X |
| 4,035,691 | 7/1977 | Altman et al. | 315/246 |
| 4,058,486 | 11/1977 | Mallozzi et al. | 250/493 |
| 4,074,208 | 2/1978 | Mack et al. | 330/4.3 X |
| 4,088,965 | 5/1978 | Lauderslager et al. | 372/69 X |

OTHER PUBLICATIONS

Friedman et al., "Transverse Flow Flashlamp Pumped Dye Laser", Jun. 1976, pp. 1494–1498, Applied Optics, vol. 15, No. 6.

*Primary Examiner*—Eugene R. Laroche
*Assistant Examiner*—Vincent De Luca
*Attorney, Agent, or Firm*—Weingarten, Schurgin, Gagnebin & Hayes

[57] ABSTRACT

A flashlamp system is described which permits the use of flashlamp tubes of increased diameter for higher average power capability while retaining the desirable characteristics of a small diameter, wall stabilized tube which includes small image size, short pulse duration and high ionization level. A series of low level pre-pulses are applied to the flashlamp prior to a main pulse to form a low density region along the flashlamp discharge axis for the main pulse for generating radially directed acoustic waves, thereby to confine the main discharge to a small low density region near the tube center. When Xenon flashlamps are used, this results in a higher ionization level of the molecules along the axis of the flashlamp which increases the ratio of the short-lived XeII emission to long-lived continuum, thereby effectively reducing pulse duration. Moreover, the arc generated in response to the application of the main pulse is localized at the tube center resulting in a smaller image to focus into an active laser medium.

24 Claims, 5 Drawing Figures

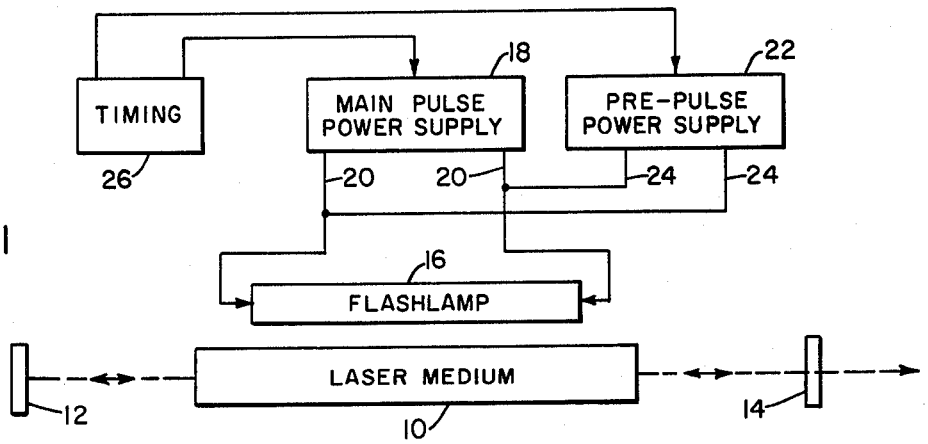
FIG. 1
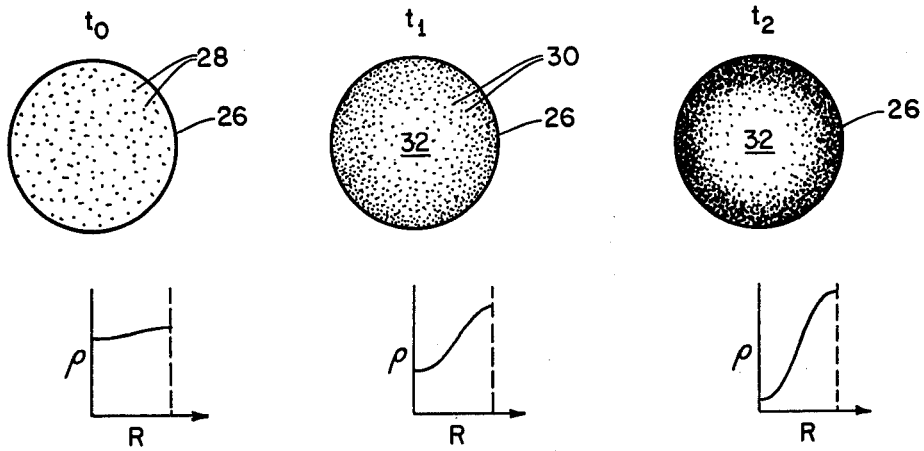
FIG. 2A FIG. 2B FIG. 2C
FIG. 3
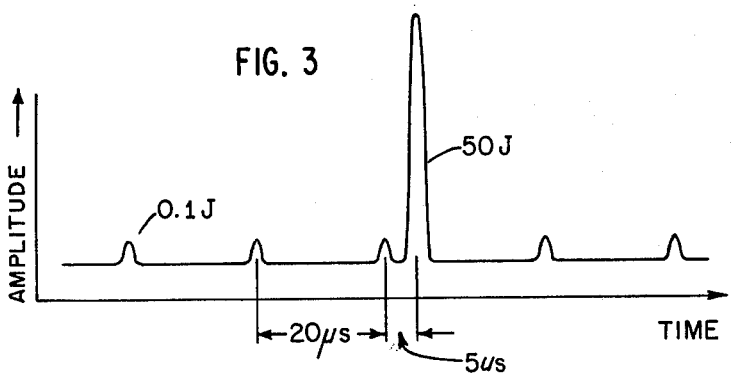

METHOD AND APPARATUS FOR IMPROVING FLASHLAMP PERFORMANCE

FIELD OF THE INVENTION

This invention relates to flashlamps and in particular to a high pulse rate, high average power, excitation system for a laser.

BACKGROUND OF THE INVENTION

As described in U.S. Pat. No. 4,074,208, issued to Michael E. Mack, et al on Feb. 14, 1978 and assigned to the assignee hereof, flashlamps have been used extensively as a source of excitation radiation for energizing a laser medium to a lasing condition. For this purpose, the radiation in the flashlamp discharge arc or high energy plasma is typically focused by lenses or mirrors into the laser medium. Laser efficiency depends in part on the degree to which the discharge can be limited in diameter so that the image focused to the center of the laser medium is likewise limited, thereby to couple a maximum amount of pumping energy to the desired lasing zone.

In addition to the requirement for a dimensionally narrowed discharge, in flowing dye lasers the flashlamp must be capable of being rapidly pulsed so as to permit the attaining of maximum laser output. In flowing dye lasers the dye is rapidly replenished, and this permits the application of pumping pulses at a high repetition rate to achieve maximum energy output.

Rapidly pulsed dye lasers are used extensively in the field of isotope separation especially as it relates to separating U-235 from U-238. Such a system is described in U.S. Pat. No. 3,772,519 issued to R. H. Levy, et al for a Method and Apparatus for the Separation of Isotopes and is assigned to the assignee hereof. The efficiency of such a laser isotope separation system depends heavily on the amount of ionizing radiation which can be pumped into the reaction region for the process.

One of the major advances with present dye laser systems has been in the area of increasing the average power capability of the laser through increasing the flashlamp diameter. However, increasing the diameter of the flashlamp decreases the watts/cm$^2$ through the flashlamp envelope. To make up for this decrease, either an increased repetition rate may be employed, or the energy per pulse can be increased, both of which having thus far proved difficult to achieve for the following reasons:

Present flashlamps used for short pulse excitation of dye lasers typically utilize Xenon. The Xenon flashlamp provides not only green XeII line radiation where desired, but also a continuum of radiation. The XeII line of the Xenon flashlamp is useful because of its short duration which makes possible the production of ultra short flashlamp pulses. However, while the XeII line radiation is short in duration, the continuum radiation can last for many microseconds, and this precludes increasing repetition rates. Moreover, the existence of continuum radiation is undesirable because much of it represents radiation ineffective to excite useful lasing states in the dye laser and thus creates heat.

Additionally, when Xenon flashlamps are operated at high pulse repetition frequencies, typically 150–200 pulses per second, the arc becomes more diffuse resulting in a loss of the XeII line spectra, a reduction in peak excitation rates, and an increase in pulse duration. The diffuse arc which results at high pulse repetition frequencies, when focused from the flashlamp into the laser medium produces a larger focused image within the laser medium. This is undesirable because it results in a lower concentration of excitation energy in the dye laser medium.

As illustrated in the aforementioned patent and in U.S. Pat. No. 3,967,212 issued to Daniel J. Dere, et al on June 29, 1976, and U.S. Pat. No. 3,842,284 issued to Berta, et al on Oct. 15, 1974, a so-called "simmer" current is often used. According to this technique, a continuous current bias is provided to permit a rapid turn on and turn off of the flashlamp with less voltage swing. When utilizing a simmer current in a large diameter tube, the arc will typically attach itself in an unstable manner to the tube wall.

By way of further background, the utilization of additional flashlamp energizing pulses is described in U.S. Pat. No. 4,004,248 issued to Alexander Muller, et al on Jan. 18, 1977, and in U.S. Pat. No. 4,088,965, issued to James B. Lauderslager, et al, in which a helium and nitrogen mixture may be made to lase at a lower pressure through the utilization of a pre-ionization pulse.

SUMMARY OF THE INVENTION

In accordance with the teaching of the present invention, a flashlamp discharge system is provided that achieves a short duration, physically-confined discharge. The flashlamp is pre-pulsed to produce a low density in a central region at the flashlamp discharge axis. This low density region is formed by a radial acoustic wave which results from a string of the pre-pulses. The acoustic wave typically travels at one millimeter per microsecond outwardly from the tube center and is reflected back by the flashlamp envelope. At the time of reflection, the density profile is optimum in that the lowest density exists at and around the central flashlamp discharge axis. The atoms or molecules within the flashlamp are thus redistributed by the pre-pulse such that the density increases from a low at the central discharge axis to a maximum at the envelope wall. When a continuous series of pre-pulses are utilized, density gradients are resonantly excited so as to establish a well defined lower density region around the central discharge axis. However, for some low repetition rate configurations, a single pre-pulse can establish enough of a low density central region to be effective.

Once this low or minimum central density region is formed, the main flashlamp pulse is generated. Minimum central density occurs when the acoustic wave used to redistribute the atoms or molecules is reflected by the flashlamp envelope wall.

The result of providing a low density region for the flashlamp discharge axis is that the power per molecule for a Xenon discharge increases greatly, which in turn results in a higher Xenon ionization level, and lower collisional quenching at the center of the tube. This higher ionization level increases the XeII emission in Xenon and improves the ratio of the XeII line to the continuum, effectively shortening the output pulse duration from the flashlamp. It is noted that the reduction in the density in the main discharge region reduces the collisional quenching of excited Xenon ions, even for relatively high fill pressures, for example, those exceeding 100 Torr.

Of additional importance, with the formation of a low density region near the tube axis, the discharge arc is dimensionally narrowed at the tube center. This results in a smaller image focused into the active zone of the laser medium and a corresponding higher concentration of pumping energy there. Higher medium excitation rates are possible because of this greater concentration of radiation.

In summary, the use of a series of pre-pulses permits the use of larger diameter flashlamp tubes which in turn increases the average power capability of the laser. For optimum results, it is important that the time between the pre-pulses and main pulse timing be proper to insure that the discharge axis pressure is lowest and that the density distribution increases outwardly. This timing varies with factors such as the energy of the pre-pulse and the fill pressure of the lamp. The proper timing can be established experimentally by varying the operative parameters until a maximum laser output is achieved. Moreover, it will be appreciated that the pre-pulse energy need not be large. In fact pre-pulse energy in excess of 0.5–1.0 J/cm$^3$ is lost to radiation and does not appreciably enhance the acoustic wave.

BRIEF DESCRIPTION OF THE DRAWINGS

These and other features will be better understood in conjunction with the following detailed description taken in connection with the drawings of which:

FIG. 1 is a schematic representation of a flashlamp system embodying the subject invention;

FIGS. 2A–2C illustrate the density distribution as a function of radial distance for three stages associated with a radial acoustic wave generated in a flashlamp by a pre-pulse; and, FIG. 3 is a waveform diagram illustrating the relative time position and amplitude of the pre-pulses with respect to the main pulse.

DETAILED DESCRIPTION

Referring now to FIG. 1, a laser medium 10 is disposed in a laser cavity defined by reflecting mirror 12 and partially reflecting mirror 14. Adjacent the laser medium is a typical flashlamp assembly 16 which, in one embodiment, is commercially available as FX-77C-13 manufactured by EG & G. Alternatively this flashlamp may take on the configuration illustrated in the aforementioned patent issued to Michael E. Mack, et al.

As illustrated, a main pulse power supply 18 is coupled to the electrodes (not shown) of flashlamp assembly 16 via lines 20. A pre-pulse power supply 22 is coupled via lines 24 in parallel with the main pulse power supply, with the timing of the outputs from the main pulse power supply and the pre-pulse power supply being determined by a timing unit 26. In one embodiment, a continuous series of pre-pulses is produced, with the main pulses being introduced at regular intervals between the pre-pulses.

It will be appreciated that flashlamp electrodes extend into the flashlamp envelope from its ends and define the ends of the discharge axis of the flashlamp. By application of very small amounts of energy and referring now to FIGS. 2A–2C, the molecules or atoms within the envelope may be displaced outwardly in a radial direction. Thus, as illustrated in FIG. 2A, at time $t_o$, the unexcited molecules or atoms within a flashlamp envelope 26 may be distributed as illustrated by dots 28 such that, as illustrated therebeneath, the density may be relatively uniform as a function of distance along a radius of the flashlamp. Immediately after the pre-pulse, a radial acoustic wave is produced which in general results in molecules or atoms being moved from the main discharge axis towards the flashlamp envelope 26 as illustrated by dots 30. This depletes the central region 32 of the flashlamp such that the density is as illustrated for time $t_1$, at the bottom of FIG. 2B.

As illustrated at time $t_2$, reflected acoustic waves result in atoms or molecules travelling towards the center of envelope 26, such that immediately after reflection the highest density of molecules or atoms exist at envelope 26, whereas the lowest density exists at central region 32. The resultant density profile is illustrated by the graph at the bottom of FIG. 2C.

As explained, if the main pulse is applied at the time of minimum central axis density, collisional quenching of the XeII ions is reduced because of the lower density of ions in the central region of the flashlamp tube 26. With less collisional quenching, more of the XeII molecules are ionized with respect to those which result in the continuum radiation. These ionized XeII molecules which have short excited state lifetimes then relax quickly giving off a short pulse of light.

The use of pre-pulses permits the use of large diameter flashlamp tubes by providing a narrowed image and the ability to increase the repetition rate, while at the same time increasing the energy output and reducing wall stabilization problems.

The appropriate timing of the pre-pulse with respect to the main pulse may be derived experimentally by varying the repetition rate for the pre-pulses and varying the timing of the main pulse relative to the pre-pulses to establish a maximum laser output. The relative timing between the pre-pulse and the main pulse depends upon the fill pressure, the energy in the pre-pulse, flashlamp parameters, and the type of flashlamp mixture utilized. In one embodiment, a continuous series of pre-pulses spaced 20 microseconds apart are used to establish a resonant condition within the flashlamp envelope, with the time between main pulses being 1 millisecond. This set of parameters applies to a 22.5 cm. tube having an inside diameter of 20 mm. andd a fill pressure of 200 Torr, with each pre-pulse having an energy of 0.1 J and the main pulse an energy of 50 J.

As can be seen from FIG. 3, a series of 0.1 J pre-pulses is shown. The main pulse repetition rate is a predetermined fraction of the pre-pulse repetition rate such that the main pulse occurs a fixed time after a preceding pre-pulse. In the above-described embodiment, the main pulse is separated in time from the preceding pre-pulse by 5 microseconds to ensure minimum central axis density by providing that the main pulse is generated at the time the radial acoustic wave is reflected. While some beneficial results obtain with the use of only one pre-pulse, the use of a series of pre-pulses is desirable to establish a more defined, less dense central zone through acoustic resonance. It will be noted that the amplitude of a pre-pulse is clearly an order of magnitude less than that of the main pulse.

While the subject system is primarily useful in dye lasers, the ability to rapidly pulse a flashlamp through the utilization of a pre-pulse and the establishment of a radial acoustic wave has application wherever rapid pumping of a laser medium is required.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A method for operating a flashlamp utilized to pump the active region of a laser medium comprising the steps of:

establishing a radial acoustic wave in ionizeable material confined in a flashlamp envelope so as to reduce the density of said ionizeable material in the region of discharge; and, applying ionizing energy to said flashlamp discharge region at the time of reduced material density.

2. The method of claim 1, wherein said ionizing energy is applied at the time of reflection of the radial acoustic wave by the envelope of the flashlamp.

3. The method of claim 2, wherein said ionizing energy is applied before the reflected acoustic wave reaches the discharge region of said flashlamp.

4. A method for operating a flashlamp utilized to pump the active region of a laser medium comprising the steps of:

establishing a decreased density of ionizeable material in the discharge region of a flashlamp; and, ionizing the material in said flashlamp discharge region at the time said decreased density is established thereby to produce a flashlamp radiation output.

5. The method of claim 4, wherein the ionizeable material in the flashlamp includes components with a short excited state lifetime, whereby the decreased density reduces collisional quenching of the short excited state lifetime components causing these components to increase their contribution to the flashlamp radiation output.

6. The method of claim 4, wherein said establishing step includes applying a pre-pulse of energy to the flashlamp prior to the ionizing step.

7. The method of claim 6, wherein said pre-pulse has an energy magnitude less than that associated with the ionizing step.

8. The method of claim 4, wherein said establishing step includes applying a series of pre-pulses of energy to the flashlamp prior to the ionizing step.

9. The method of claim 4, wherein said ionizeable material includes Xenon and wherein the establishment of the decreased density region results in the XeII line dominating the response of the flashlamp.

10. A method for narrowing the image of radiation from a flashlamp utilized to pump the active region of a laser medium comprising the steps of:

establishing at the region of discharge of a flashlamp a decreased density of ionizeable material; and, ionizing the material in said flashlamp discharge region at the time of decreased density.

11. The method of claim 10, wherein the ionizeable material in the flashlamp includes components with a short excited state lifetime, whereby the decreased density narrows the region of ionization of the flashlamp material and reduces collisional quenching of the short excited state lifetime components causing said components to increase in the contribution to the output of the flashlamp.

12. The method of claim 10, wherein the establishing step includes the step of applying a pre-pulse of energy to the flashlamp, the pre-pulse having energy at least an order of magnitude less than that associated with the ionizing step.

13. The method of claim 10, wherein the establishing step includes the step of applying a pre-pulse of energy to the flashlamp, the pre-pulse being generated prior to the ionizing step.

14. The method of claim 10, wherein the establishing step includes the step of applying multiple pre-pulses to the flashlamp so as to establish a resonant condition therein.

15. Apparatus for controlling the operation of a flashlamp utilized to pump the active region of a laser medium comprising:

a flashlamp including an envelope surrounding a region of discharge;

means for establishing a radially directed acoustic wave in the flashlamp envelope so as to reduce the density of ionizeable material within the flashlamp in the region of discharge; and, means for applying ionizing energy to said flashlamp discharge region at the time of reduced material density.

16. The apparatus of claim 15, wherein said ionizing energy is applied at the time of reflection of the radial acoustic wave by the envelope of the flashlamp.

17. The apparatus of claim 15, wherein said ionizing energy is applied before the acoustic wave reflected by the envelope of the flashlamp reaches the discharge region of said flashlamp.

18. Apparatus for controlling the operation of a flashlamp having ionizeable material and a region of discharge, comprising:

means for establishing in the region of discharge of the flashlamp a region of acoustically induced decreased density of ionizeable material; and, means for ionizing the decreased density of the ionizeable material in said discharge region in the flashlamp to produce a flashlamp output.

19. The apparatus of claim 18, wherein the ionizeable material in the flashlamp includes components with a short excited state lifetime, whereby the decreased density narrows the region of ionization and reduces collisional quenching of the short excited state lifetime components causing said components to increase their contribution in the output of the flashlamp.

20. The apparatus of claim 18, wherein said establishing means includes means for applying a pre-pulse of energy to the ionizeable material in the flashlamp prior to applying ionizing energy.

21. The apparatus of claim 18, wherein said establishing means includes means for applying a series of pre-pulses of energy to the ionizeable material in the flashlamp prior to applying ionizing energy.

22. The apparatus of claim 18, wherein said ionizeable material incluses Xenon and wherein the establishment of the decreased density region results in the XeII line increasing in the output of the flashlamp.

23. A method for decreasing the duration of pulses from a flashlamp utilized to pump the active region of a laser medium comprising the steps of:

establishing a radial acoustic wave in ionizeable material confined in a flashlamp envelope so as to reduce the density of said ionizeable material in the region of discharge; and, applying ionizing energy to said flashlamp discharge region at the time of reduced material density.

24. A method for decreasing the duration of pulses from a flashlamp utilized to pump the active region of a laser medium comprising the steps of:

establishing an acoustically decreased density of ionizeable material in the discharge region of a flashlamp; and, ionizing the material in said flashlamp discharge region at the time said decreased density is established thereby to produce a flashlamp radiation output.

* * * * *